US011499713B2

(12) United States Patent
Sura et al.

(10) Patent No.: US 11,499,713 B2
(45) Date of Patent: Nov. 15, 2022

(54) HANDHELD WELDING TORCH APPARATUS

(71) Applicants: Rene Sura, Northridge, CA (US); Kelin Mendoza, Northridge, CA (US); Jose Pineda, Northridge, CA (US)

(72) Inventors: Rene Sura, Northridge, CA (US); Kelin Mendoza, Northridge, CA (US); Jose Pineda, Northridge, CA (US)

( * ) Notice: Subject to any disclaimer, the term of this patent is extended or adjusted under 35 U.S.C. 154(b) by 148 days.

(21) Appl. No.: 16/935,363

(22) Filed: Jul. 22, 2020

(65) Prior Publication Data

US 2022/0026060 A1 Jan. 27, 2022

(51) Int. Cl.

| | |
|---|---|
| ***F23D 14/40*** | (2006.01) |
| ***F23D 14/28*** | (2006.01) |
| ***F23D 14/52*** | (2006.01) |
| ***F23D 14/54*** | (2006.01) |
| *F23D 14/46* | (2006.01) |

(52) U.S. Cl.

CPC ..... *F23D 14/40* (2013.01); *F23D 14/28* (2013.01); *F23D 14/52* (2013.01); *F23D 14/54* (2013.01); *F23D 14/465* (2013.01)

(58) Field of Classification Search

CPC ..... F23D 14/40; F23D 14/28; F23D 14/52; F23D 14/54; F23D 14/565; F23D 2206/0031; F23D 14/465

USPC ..... 431/344, 142, 345; 126/413, 414, 236

See application file for complete search history.

(56) References Cited

U.S. PATENT DOCUMENTS 1,422,740 A * 7/1922 Cohen ..... F23D 91/02 12/136 R
1,780,152 A * 11/1930 Birnbaum ..... F23D 91/02 431/230
1,793,052 A * 2/1931 Buttner ..... F23D 14/465 116/63 R (Continued)

FOREIGN PATENT DOCUMENTS

CA 1206862 A * 7/1986 ..... F17C 13/04
DE 102006024953 A1 * 3/2007 ..... F23D 14/28

(Continued)

OTHER PUBLICATIONS

"_16935363, Bing Search, 2022-06-22.pdf", online BING search, Jun. 22, 2022. (Year: 2022).*

(Continued)

*Primary Examiner* — Steven B McAllister
*Assistant Examiner* — Daniel E. Namay

(57) ABSTRACT

A handheld welding torch apparatus for welding in confined areas includes a gas tank having a handle portion and an extension portion. Each of the handle portion and the extension portion is cylindrical. A valve assembly is coupled to the gas tank and comprises a tank receiver, a tube stem, a valve housing, and a control valve. The tube stem is coupled to the tank receiver. The tube stem is in fluid communication with the gas tank when the tank receiver is engaged with the extension portion. The valve housing is coupled to, and in fluid communication with, the tube stem. The control valve is coupled within, and in fluid communication with, the valve housing. A tube neck is coupled to, and in fluid communication with, the control valve. A welding tip is coupled to the tube neck.

10 Claims, 4 Drawing Sheets

(56) References Cited

U.S. PATENT DOCUMENTS 2,109,251 A * 2/1938 Jacobsson ..... F23D 14/465 137/893
2,186,760 A * 1/1940 Lenk ..... F23D 91/02 431/241
2,683,484 A * 7/1954 Louisa ..... F23D 91/02 251/210
2,934,308 A * 4/1960 Kaufmann ..... F23D 91/02 251/114
3,388,962 A 6/1968 Baumann
3,574,506 A 4/1971 Locke
3,674,413 A * 7/1972 Fraser ..... F23Q 13/04 239/588
5,564,918 A 10/1996 Lin
5,725,369 A * 3/1998 Tsai ..... F23D 14/28 431/255
5,857,262 A * 1/1999 Bonnema ..... F24H 3/0488 431/344
6,065,959 A 5/2000 Tsai
6,196,833 B1 * 3/2001 Ho ..... F23D 14/38 431/153
6,257,875 B1 7/2001 Johnstone
D594,300 S 6/2009 Ibarraondo
7,850,446 B2 * 12/2010 Tsai ..... F23Q 3/002 431/153
8,753,111 B2 * 6/2014 Nolan ..... F23D 14/08 431/255
8,915,456 B2 * 12/2014 Burdsall ..... B23K 3/022 239/581.1
9,199,367 B2 * 12/2015 Tatarczuk ..... F23D 14/38
9,568,188 B2 2/2017 Kim
9,612,012 B2 * 4/2017 Yang ..... F23D 14/38
9,822,971 B2 * 11/2017 Lee ..... F23D 14/28
9,869,471 B2 * 1/2018 Yang ..... F23D 14/52
10,060,623 B2 * 8/2018 Yang ..... F23D 14/28
10,962,221 B2 * 3/2021 Wu ..... F23D 14/38
2003/0203331 A1 * 10/2003 Hsu ..... F23D 14/40 431/153
2005/0202359 A1 * 9/2005 Lin ..... F23Q 2/287 431/153
2006/0005829 A1 * 1/2006 Lin ..... F23D 14/72 126/401
2008/0274434 A1 * 11/2008 Burdsall ..... F23D 14/465 215/44
2009/0068606 A1 * 3/2009 Tsai ..... F23D 14/38 431/255
2012/0074244 A1 * 3/2012 Burdsall ..... F23D 14/40 239/526
2013/0089825 A1 * 4/2013 Nolan ..... F23D 14/52 431/353
2014/0252131 A1 * 9/2014 Nolan ..... F23D 14/52 239/399
2015/0076255 A1 * 3/2015 Burdsall ..... F23N 1/007 239/526
2015/0354812 A1 * 12/2015 Yang ..... F23D 14/62 431/364
2015/0354813 A1 * 12/2015 Yang ..... F23D 14/28 431/364
2016/0097530 A1 * 4/2016 Tsai ..... F23Q 3/002 431/255
2016/0281980 A1 * 9/2016 Lee ..... F23D 14/465
2017/0074510 A1 * 3/2017 Yang ..... F23D 14/28
2017/0074511 A1 * 3/2017 Yang ..... F23D 14/38
2018/0066842 A1 * 3/2018 Tsai ..... F23D 14/38
2020/0080721 A1 * 3/2020 Hiraga ..... F23D 14/52
2020/0149739 A1 * 5/2020 Wu ..... F23D 14/465
2020/0386402 A1 * 12/2020 Tsai ..... F23D 14/465
2021/0063014 A1 * 3/2021 Dadig ..... B23K 9/296

FOREIGN PATENT DOCUMENTS

DE 202011103766 U1 * 1/2012 ..... F23D 14/52
GB 236520 A * 4/1925 ..... F23D 2206/0031
JP 2233906 A * 9/1990 ..... F23N 5/02
JP 2002089804 A * 3/2002 ..... F23D 14/28
JP 2002327909 A * 11/2002 ..... F23D 14/28
JP 2017146070 A * 8/2017 ..... F23D 14/48
KR 900003848 Y1 * 5/1990 ..... F23D 14/465
WO WO9952355 10/1999

OTHER PUBLICATIONS

"_16935363, IQSearchDownload-202206222148.pdf", online ProQuest search, ip.com, Jun. 22, 2022. (Year: 2022).*

* cited by examiner

HANDHELD WELDING TORCH APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to welding devices and more particularly pertains to a new welding device for welding in confined areas.

(2) Description of Related Art Including Information Disclosed Under 37 CFR 1.97 and 1.98

The prior art relates to welding devices and blow torches. Existing devices have standard cylindrical gas tanks or connect with a hose to a gas tank. Such devices lack a tank incorporated into a handle. Existing devices also do not include a rotating adjustable welding tip.

BRIEF SUMMARY OF THE INVENTION

An embodiment of the disclosure meets the needs presented above by generally comprising a gas tank having a handle portion and an extension portion. Each of the handle portion and the extension portion is cylindrical. A valve assembly is coupled to the gas tank and comprises a tank receiver, a tube stem, a valve housing, and a control valve. The tank receiver selectively receives a distal end of the extension portion. The tube stem is coupled to the tank receiver. The tube stem is in fluid communication with the gas tank when the tank receiver is engaged with the extension portion. The valve housing is coupled to, and in fluid communication with, the tube stem. The control valve is coupled within, and in fluid communication with, the valve housing. A tube neck is coupled to, and in fluid communication with, the control valve. A welding tip is coupled to the tube neck.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
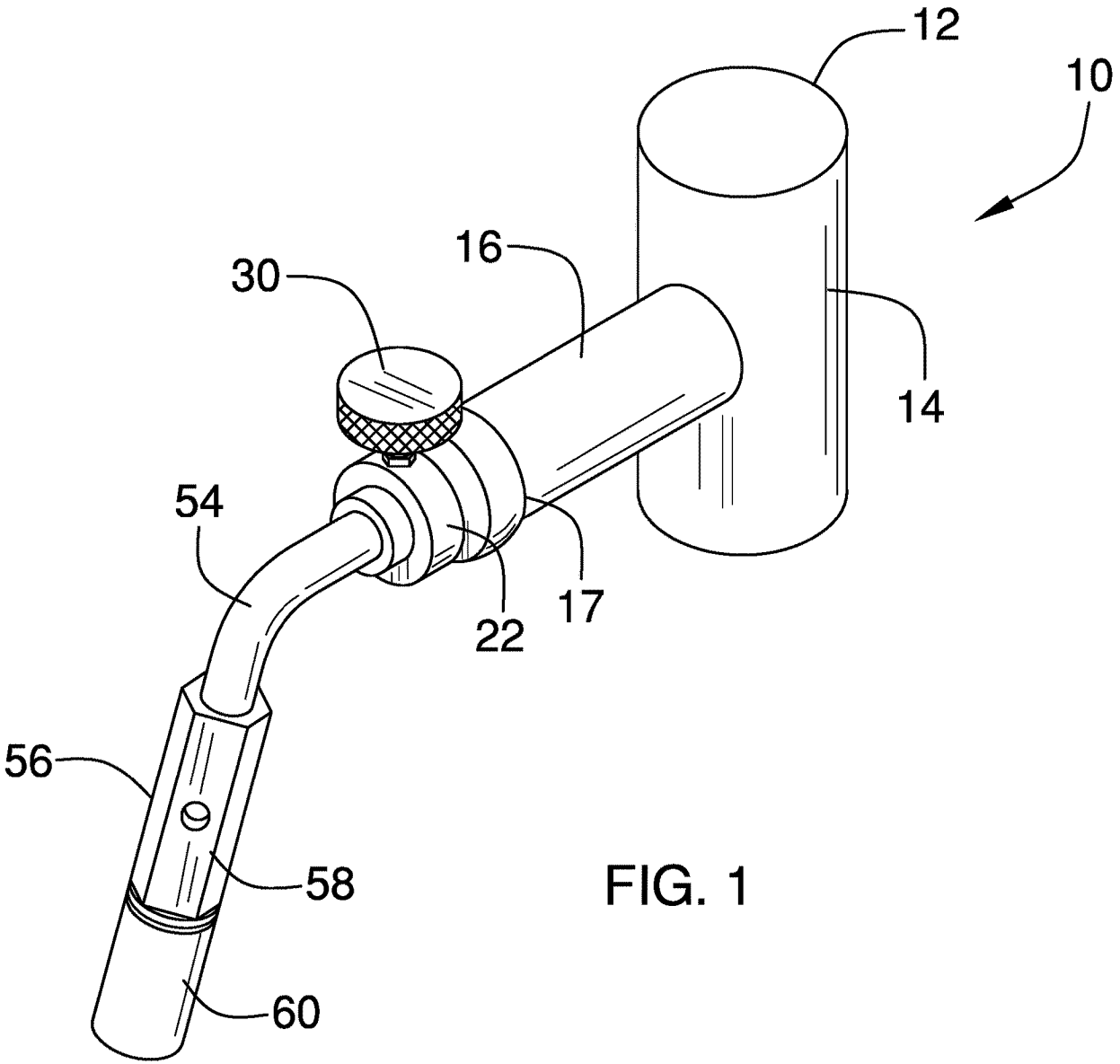
FIG. 1 is an isometric view of a handheld welding torch apparatus according to an embodiment of the disclosure.
Figure 2:
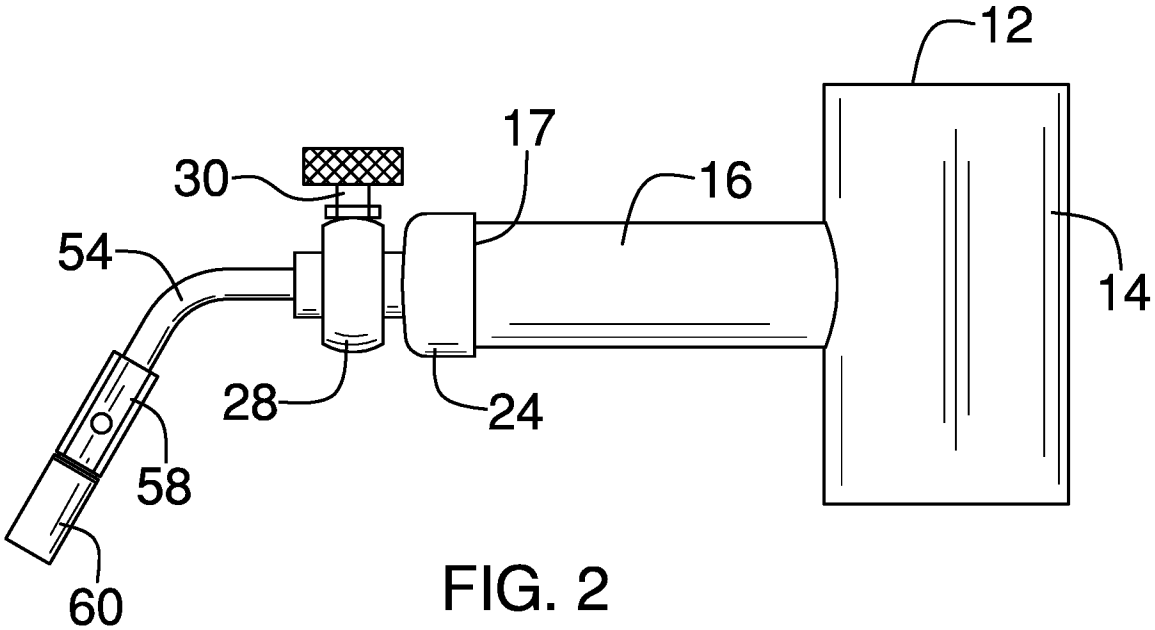
FIG. 2 is a side elevation view of an embodiment of the disclosure.
Figure 3:
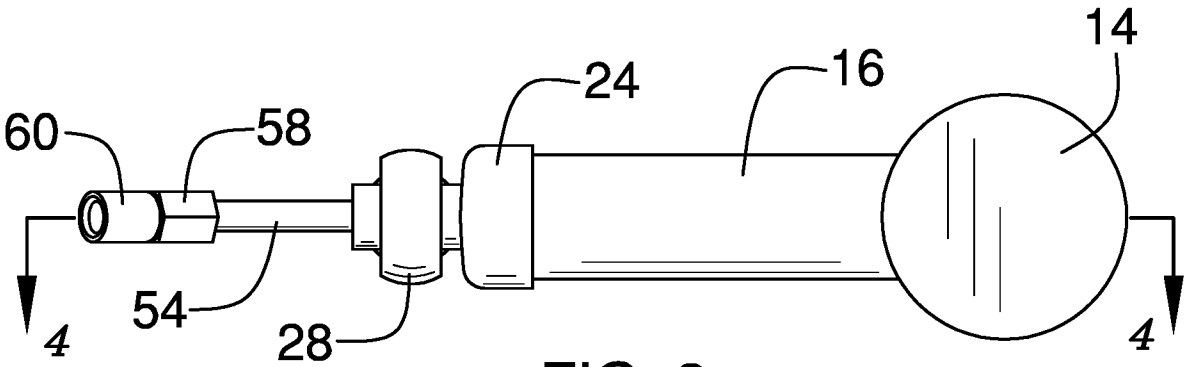
FIG. 3 is a bottom plan view of an embodiment of the disclosure.
Figure 4:
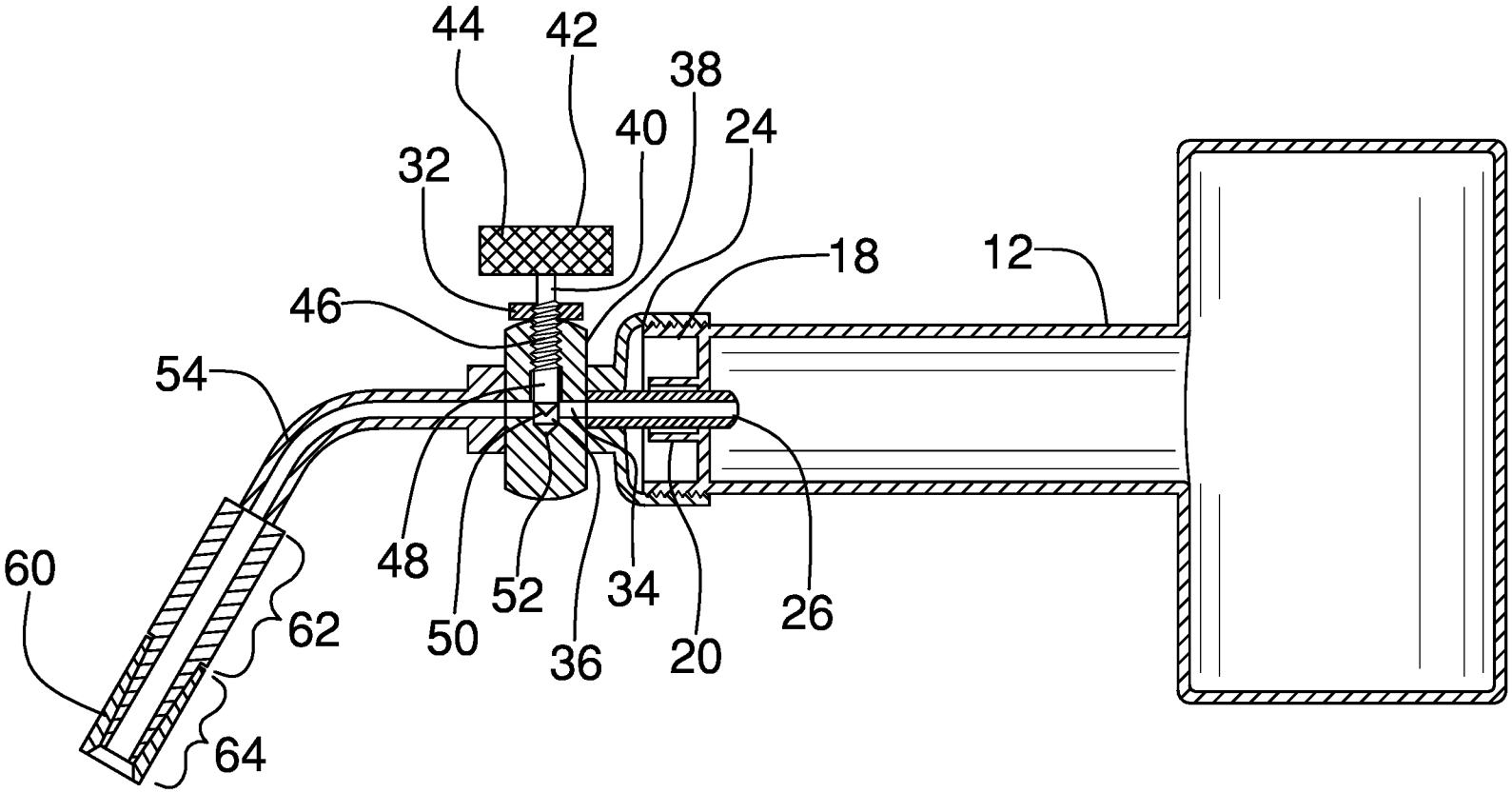
FIG. 4 is a cross-sectional view of an embodiment of the disclosure along the line 4-4 of FIG. 3.

With reference now to the drawings, and in particular to FIGS. 1 through 5 thereof, a new welding device embodying the principles and concepts of an embodiment of the disclosure and generally designated by the reference numeral 10 will be described.

Figure 5:
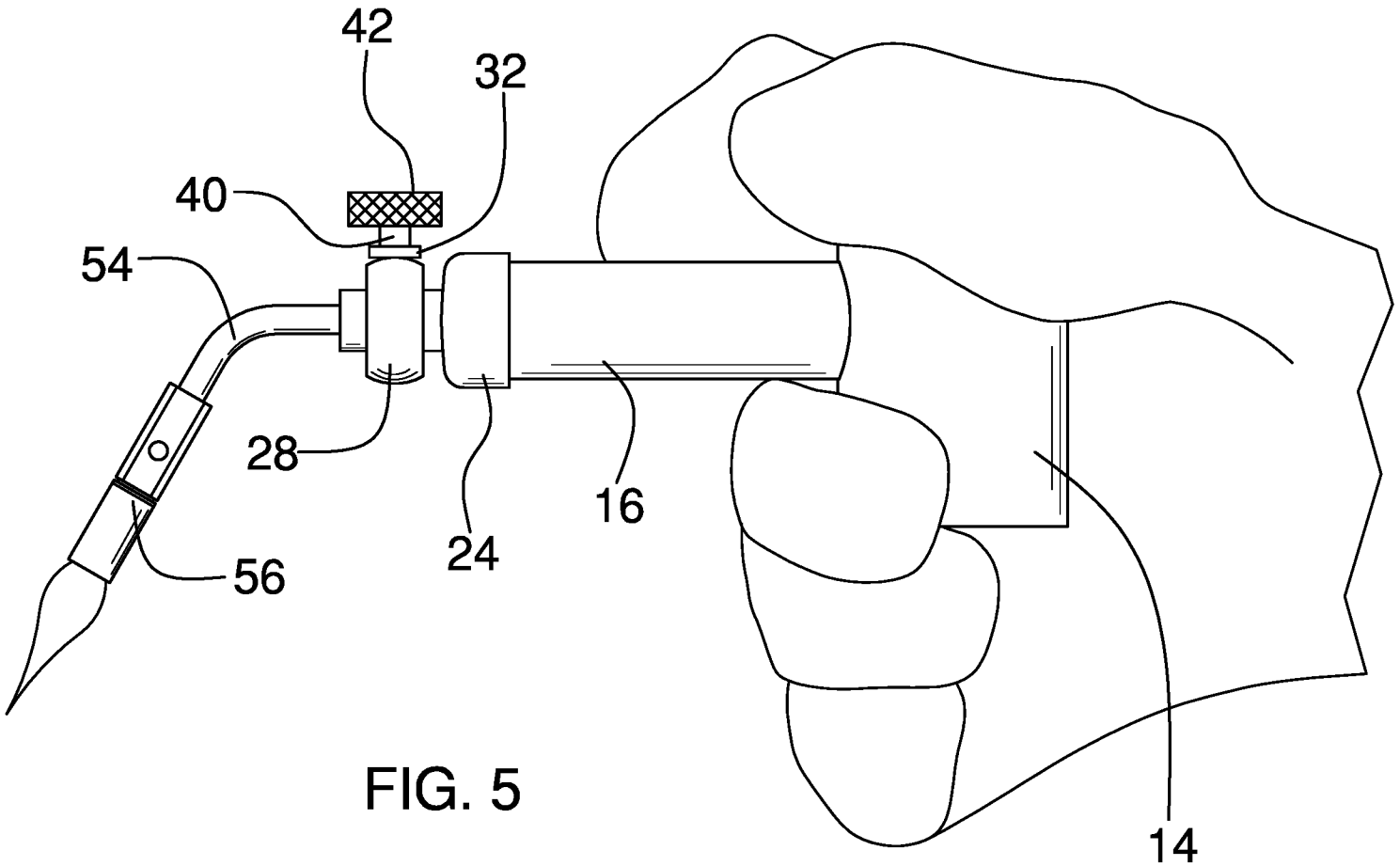
FIG. 5 is an in-use view of an embodiment of the disclosure.

As best illustrated in FIGS. 1 through 5, the handheld welding torch apparatus 10 generally comprises a gas tank 12 having a handle portion 14 and an extension portion 16. Each of the handle portion 14 and the extension portion 16 may be cylindrical. The extension portion 16 is perpendicular to the handle portion 14. The diameter of the extension portion 16 is less than the diameter of the handle portion 14 and both are dimensioned to be held within a user's hand with the extension portion 16 between the user's fingers as shown in FIG. 5. A distal end 17 of the extension portion 16 has a threaded outer collar 18 and an inner nipple portion 20.

A valve assembly 22 is coupled to the gas tank 12. The valve assembly 22 comprises a tank receiver 24, a tube stem 26, a valve housing 28, a control valve 30, and a stop ring 32. The tank receiver 24 is coupled to the gas tank 12 with the tank receiver 24 threadably receiving the outer collar 18 of the distal end. The tube stem 26 is coupled to the tank receiver 24. The tube stem 26 selectively engages the inner nipple portion 20 of the distal end to be in fluid communication with the gas tank 12 when the tank receiver 24 is engaged with the extension portion 16.

The valve housing 28 is coupled to the tube stem 26. The valve housing 28 has a bypass channel 34 in fluid communication with the tube stem 26 and a valve aperture 36 extending from an outer face 38 through to the bypass channel 34. The control valve 30 is coupled within the valve housing 28 and is in fluid communication with the valve housing 28. The control valve 30 has a valve stem 40 threadably engaged within the valve aperture 36 and a valve knob 42 coupled to the valve stem 40. The valve knob 42 may have a knurled grip face 44. The valve stem 40 may have a threaded portion 46 and a smooth blockage portion 48. The smooth blockage portion 48 may have a pointed tip 50 to engage a pointed receiver end 52 of the valve aperture 36 for full closure of the bypass channel 34. The stop ring 32 is threadably engaged with the threaded portion 46 of the valve stem to lock the control valve 30 in a desired position.

A tube neck 54 is coupled to the control valve 30. The tube neck 54 is in fluid communication with bypass channel 34 of the control valve 30. The tube neck 54 may form a rounded angle between 135° and 180°. A welding tip 56 is coupled to the tube neck 54. The welding tip 56 may have a fixed portion 58 and a rotatable portion 60 rotatably coupled to the fixed portion 58. The fixed portion 58 has a faceted section 62 and a tapered section 64. The rotatable portion 60 is coupled to the tapered section 64.

In use, the user secures the gas tank 12 and adjusts the control valve 30 to the desired output and lights a flame coming from the welding tip 56. The user then adjusts the rotatable portion 60 of the welding tip to achieve the desired flame before using the apparatus 10 to create welds in difficult to reach places.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A handheld welding torch apparatus comprising:

a gas tank having a handle portion and an extension portion in fluid communication with the handle portion, each of the handle portion and the extension portion being cylindrical, a longitudinal axis of the extension portion being perpendicular to a longitudinal axis of the handle portion, s aid extension portion being centered between longitudinally opposite ends of s aid handle portion;

a valve assembly coupled to the gas tank, the valve assembly comprising:

a tank receiver coupled to the gas tank, the tank receiver selectively receiving a distal end of the extension portion;

a tribe stem coupled to the tank receiver, the tube stem being in fluid communication with the gas tank when the tank receiver is engaged with the extension portion;

a valve housing coupled to the tube stem, the valve housing being in fluid communication with the tube stem; and a control valve coupled within the valve housing, the control valve being in fluid communication with the valve housing;

a tube neck coupled to the control valve, the tube neck being in fluid communication with the control valve; and a welding tip coupled to the tube neck.

2. The handheld welding torch apparatus of claim 1 further comprising the diameter of the extension portion being less than the diameter of the handle portion.

3. The handheld welding torch apparatus of claim 1 further comprising the distal end of the extension portion having a threaded outer collar and an inner nipple portion; the tank receiver threadably receiving the outer collar of the distal end; the tube stem selectively engaging the inner nipple portion.

4. The handheld welding torch apparatus of claim 1 further comprising the valve housing having a bypass channel in fluid communication with the tube stem and a valve aperture extending from an outer face through to the bypass channel, the control valve having a valve stem threadably engaged within the valve aperture and a valve knob coupled to the valve stem.

5. The handheld welding torch apparatus of claim 4 further comprising the valve stem having a threaded portion and a smooth blockage portion the smooth blockage portion having a pointed tip.

6. The handheld welding torch apparatus of claim 5 further comprising a stop ring threadably engaged with the threaded portion of the valve stem.

7. The handheld welding torch apparatus of claim 1 further comprising the tube neck forming a rounded angle between 135° and 180°.

8. The handheld welding torch apparatus of claim 1 further comprising the welding tip having a fixed portion and a rotatable portion rotatably coupled to the fixed portion.

9. The handheld welding torch apparatus of claim 8 further comprising the fixed portion having a faceted section and a tapered section, the rotatable portion being coupled to the tapered section.

10. A handheld welding torch apparatus comprising:

a gas tank having a handle portion and an extension portion in fluid communication with the handle portion, each of the handle portion and the extension portion being cylindrical, a longitudinal axis of the extension portion being perpendicular to a longitudinal axis of the handle portion, said extension portion being centered between longitudinally opposite ends of s aid handle portion, the diameter of the extension portion being less than the diameter of the handle portion, a distal end of the extension portion having a threaded outer collar and an inner nipple portion;

a valve assembly coupled to the gas tank, the valve assembly comprising:

a tank receiver coupled to the gas tank, the tank receiver threadably receiving the outer collar of the distal end;

a tube stem coupled to the tank receiver, the tube stem selectively engaging the inner nipple portion of the distal end, the tube stem being in fluid communication with the gas tank when the tank receiver is engaged with the extension portion;

a valve housing coupled to the tube stem, the valve housing having a bypass channel in fluid communication with the tube stem and a valve aperture extending from an outer face through to the bypass channel;

a control valve coupled within the valve housing, the control valve being in fluid communication with the valve housing, the control valve having a valve stem threadably engaged within the valve aperture and a valve knob coupled to the valve stem, the valve stem having a threaded portion and a smooth blockage portion, the smooth blockage portion having a pointed tip; and a stop ring threadably engaged with the threaded portion of the valve stem;

a tube neck coupled to the control valve, the tube neck being in fluid communication with the control valve, the tube neck forming a rounded angle between 135° and 180°; and a welding tip coupled to the tube neck, the welding tip having a fixed portion and a rotatable portion rotatably coupled to the fixed portion, the fixed portion having a faceted section and a tapered section, the rotatable portion being coupled to the tapered section.

* * * * *